US012781488B2

(12) United States Patent
Krause et al.

(10) Patent No.: US 12,781,488 B2
(45) Date of Patent: Nov. 3, 2026

(54) TOILET CLEANING TABLET HOLDER

(71) Applicant: Scrub Daddy, Inc., Pennsauken, NJ (US)

(72) Inventors: Aaron Krause, Pennsauken, NJ (US); Perrin Bauder, Pennsauken, NJ (US); Aleksandrs Titovs, Pennsauken, NJ (US); Jared Sobel, Pennsauken, NJ (US); Evan Bennis, Pennsauken, NJ (US)

(73) Assignee: SCRUB DADDY, INC., Pennsauken, NJ (US)

( * ) Notice: Subject to any disclaimer, the term of this patent is extended or adjusted under 35 U.S.C. 154(b) by 88 days.

(21) Appl. No.: 18/928,974

(22) Filed: Oct. 28, 2024

(65) Prior Publication Data

US 2025/0146262 A1 May 8, 2025

Related U.S. Application Data

(60) Provisional application No. 63/596,798, filed on Nov. 7, 2023.

(51) Int. Cl.
*E03D 9/03* (2006.01)
*E03D 9/02* (2006.01)

(52) U.S. Cl.
CPC ..... *E03D 9/032* (2013.01); *E03D 2009/024* (2013.01)

(58) Field of Classification Search
CPC ..... A47K 5/03; A47K 5/05; E03D 2009/024; E03D 9/005; E03D 9/03; E03D 9/032
USPC ..... D23/208
See application file for complete search history.

(56) References Cited

U.S. PATENT DOCUMENTS

| | | | | | |
|---|---|---|---|---|---|
| 1,880,912 | A | * | 10/1932 | Duwelius | E03D 9/032 4/231 |
| D192,314 | S | * | 3/1962 | Brownstein | D23/208 |
| D211,575 | S | * | 7/1968 | Weinsteain | D23/208 |
| 4,096,593 | A | * | 6/1978 | Vlahakis | E03D 9/032 4/231 |
| 2008/0169208 | A1 | * | 7/2008 | Li | A47K 5/05 220/601 |

FOREIGN PATENT DOCUMENTS

| | | | | |
|---|---|---|---|---|
| EP | 2765248 | * | 8/2014 | E03D 9/032 |
| EP | 3477010 | * | 5/2019 | E03D 9/032 |
| WO | WO2019186247 | * | 10/2019 | E03D 9/032 |

* cited by examiner

*Primary Examiner* — David P Angwin
*Assistant Examiner* — Nicholas A Ros
(74) *Attorney, Agent, or Firm* — Troutman Pepper Locke LLP

(57) ABSTRACT

An in-toilet dissolvable cleaning tablet holder which comprises a basket structured to contain the cleaning tablet. The basket is characterized by a bottom surface and at least one side wall, each incorporating aperture cutouts to allow contact between the tablet and the toilet bowl water. The basket is connected to an arm mechanism, which is configured for attachment to the rim of a toilet. The positioning of the aperture cutouts is such that, upon installation, the perimeter of at least one of the cutouts comes into contact with the toilet bowl.

18 Claims, 9 Drawing Sheets

TOILET CLEANING TABLET HOLDER

CROSS REFERENCE TO RELATED APPLICATIONS

This application claims the benefit of priority of U.S. Provisional Patent Application Ser. No. 63/596,798, filed on Nov. 7, 2023, entitled "Toilet Cleaning Tablet Holder," the entire contents of which are hereby incorporated by reference herein.

FIELD

The present subject matter relates generally to toilet cleaning accessories and, more particularly, to an in-toilet tablet holder for securely holding and optimizing the dissolution of dissolvable toilet cleaning tablets.

BACKGROUND

Toilet cleaning is an essential but often undesirable task that relies on a combination of both cleaning agents and mechanical tools. With an increasing emphasis on user-friendly mechanisms, there is a growing demand for efficient and hygienic systems to deploy cleaning agents, especially in the toilet bowl, where direct manual interaction is least desired.

A popular agent in the cleaning process is the dissolvable toilet cleaning tablet. These tablets, once exposed to water, break down to release deodorizing and sanitizing compounds. However, an inherent challenge with these tablets is their placement within the toilet bowl. Due to the variety in toilet bowl designs, ranging from shape to size variations, it can be important for any cleaning system to be adaptable to these differences. Furthermore, considering the tablets' dissolvable nature, the way they interact with the toilet water can profoundly influence their efficacy. Too rapid a dissolution might waste the cleaning potential, while too slow a release might not provide the desired cleaning effect. Further, many people would prefer to not have to touch a toilet cleaning tablet. Toilet cleaning tablets should be capable of being used such that a user need not touch them.

An optimal cleaning system would therefore offer a solution that holds these tablets securely, promotes their efficient dissolution, and can adapt to a range of toilet bowl designs. Additionally, the integration of non-touch features into such a system can significantly elevate the user experience by providing more hygienic interactions.

SUMMARY

In some embodiments, the present disclosure comprises an in-toilet tablet holder for a dissolvable cleaning tablet. In some embodiments, the in-toilet tablet holder includes a basket for holding the dissolvable cleaning tablet. In some embodiments, the basket may include a bottom surface and at least one side wall, where an aperture cutout is formed through the bottom surface and the at least one side wall. In some embodiments, the in-toilet tablet holder includes an arm mechanism attached to the basket and configured to attach to a rim of a toilet such that at least a portion of a perimeter of the aperture cutout is in contact with a bowl of the toilet. In some embodiments, the in-toilet tablet holder is designed such that the dissolvable cleaning tablet within the basket can contact the bowl of the toilet through the aperture cutout such that water from the bowl of the toilet can interface with the dissolvable cleaning tablet.

In some embodiments, the aperture cutout is angled with respect to the bottom surface such that the bottom surface is at an angle with respect to the rim of the toilet when the perimeter of the aperture cutout is in contact with the bowl of the toilet. In some embodiments, the angle is between 15 and 75 degrees. In some embodiments, the bottom surface further forms therethrough a plurality of ridged cutouts, and where each of the plurality of ridged cutouts are configured to act as a ledge to locate at least a portion of the dissolvable cleaning tablet in contact with the bowl of the toilet through the aperture cutout. In some embodiments, each of the plurality of ridged cutouts are substantially parallel with one another. In some embodiments, the bottom surface further forms therethrough a plurality of ridged cutouts, where each of the plurality of ridged cutouts are configured to act as a ledge to locate at least a portion of the dissolvable cleaning tablet in contact with the bowl of the toilet through the aperture cutout, where the at least one side wall further forms therethrough a plurality of side cutouts through which water from the toilet can flow, and where each of the plurality of ridged cutouts is connected to at least one of the plurality of side cutouts such that each of the plurality of ridged cutouts and side cutouts are formed by one cutout. In some embodiments, water can flow in to and out of the basket through one or more of the plurality of side cutouts.

In some embodiments, the arm mechanism may include: a base portion; an upper portion connected to and at an angle with respect to the base portion; a flat portion; and an outer portion. In some embodiments, the base portion is configured to attach to the rim of the basket. In some embodiments, the upper portion is configured to maintain the basket at a predetermined height above the bowl of the toilet, the flat portion is configured to rest against the rim of the toilet, and the outer portion is designed to rest against an exterior surface of the bowl of the toilet. In some embodiments, the arm mechanism is configured to curl within itself, the curl facilitated by the flat portion being bendable downwards towards the basket and the outer portion being bendable upwards away from the basket. In some embodiments, the arm mechanism is further configured to uncurl for placement over the rim of a toilet bowl.

In some embodiments, the cleaning tablet within the basket may be configured to attach to a wand, said wand being pressable into the cleaning tablet, and where a force required for attachment is provided by the dissolvable cleaning tablet either abutting against the bowl of the toilet, abutting against the bottom surface of the basket, or both.

In some embodiments, the present disclosure comprises an in-toilet tablet holder for a dissolvable cleaning tablet. In some embodiments, the in-toilet tablet holder includes an arm mechanism attached to a basket and configured to attach to a rim of a toilet. In some embodiments, the basket is attached to the arm mechanism and configured such, when installed on the toilet, that a bottom surface of the basket is at an angle with respect to a top surface of the rim of the toilet. In some embodiments, the bottom surface of the basket forms therethrough a plurality of ridged cutouts configured to act as a ledge to locate at least a portion of the cleaning tablet in closer proximity to a bowl of the toilet.

In some embodiments, each of the plurality of ridged cutouts are substantially parallel with one another. In some embodiments, the basket further may include at least one side wall may include a plurality of side cutouts formed therethrough through which water from the toilet can flow. In some embodiments, water can flow in to and out of the basket through one or more of the plurality of side cutouts. In some embodiments, the basket further may include at least one side wall, where an aperture cutout is formed through the bottom surface and the at least one side wall, where the arm mechanism is configured to attach to the rim of the toilet such that at least a portion of a perimeter of the aperture cutout is in contact with the bowl of the toilet, and where the cleaning tablet within the basket can contact the bowl of the toilet through the aperture cutout such that water from the bowl of the toilet can interface with the cleaning tablet. In some embodiments, each of the plurality of ridged cutouts is connected to at least one of the plurality of side cutouts such that each of the plurality of ridged cutouts and side cutouts are formed by one cutout. In some embodiments, the aperture cutout is angled with respect to the bottom surface such that the bottom surface of the basket is at an angle with respect to the top surface of the rim of the toilet. In some embodiments, the angle is between 15 and 75 degrees.

In some embodiments, the arm mechanism may include: a base portion; an upper portion connected to and at an angle with respect to the base portion; a flat portion; and an outer portion. In some embodiments, the base portion is configured to attach to the rim of the toilet, the upper portion is configured to maintain the basket at a predetermined height above the bowl of the toilet, the flat portion is configured to rest against the rim of the toilet, and the outer portion is designed to rest against an exterior surface of the bowl of the toilet to stabilize the in-toilet tablet holder.

In some embodiments, the cleaning tablet within the basket may be configured to attach to a wand, said wand being pressable into the cleaning tablet, and a force required for attachment is provided by the cleaning tablet either abutting against the bowl of the toilet, abutting against the bottom surface of the basket, or both.

DETAILED DESCRIPTION

Figure 1:
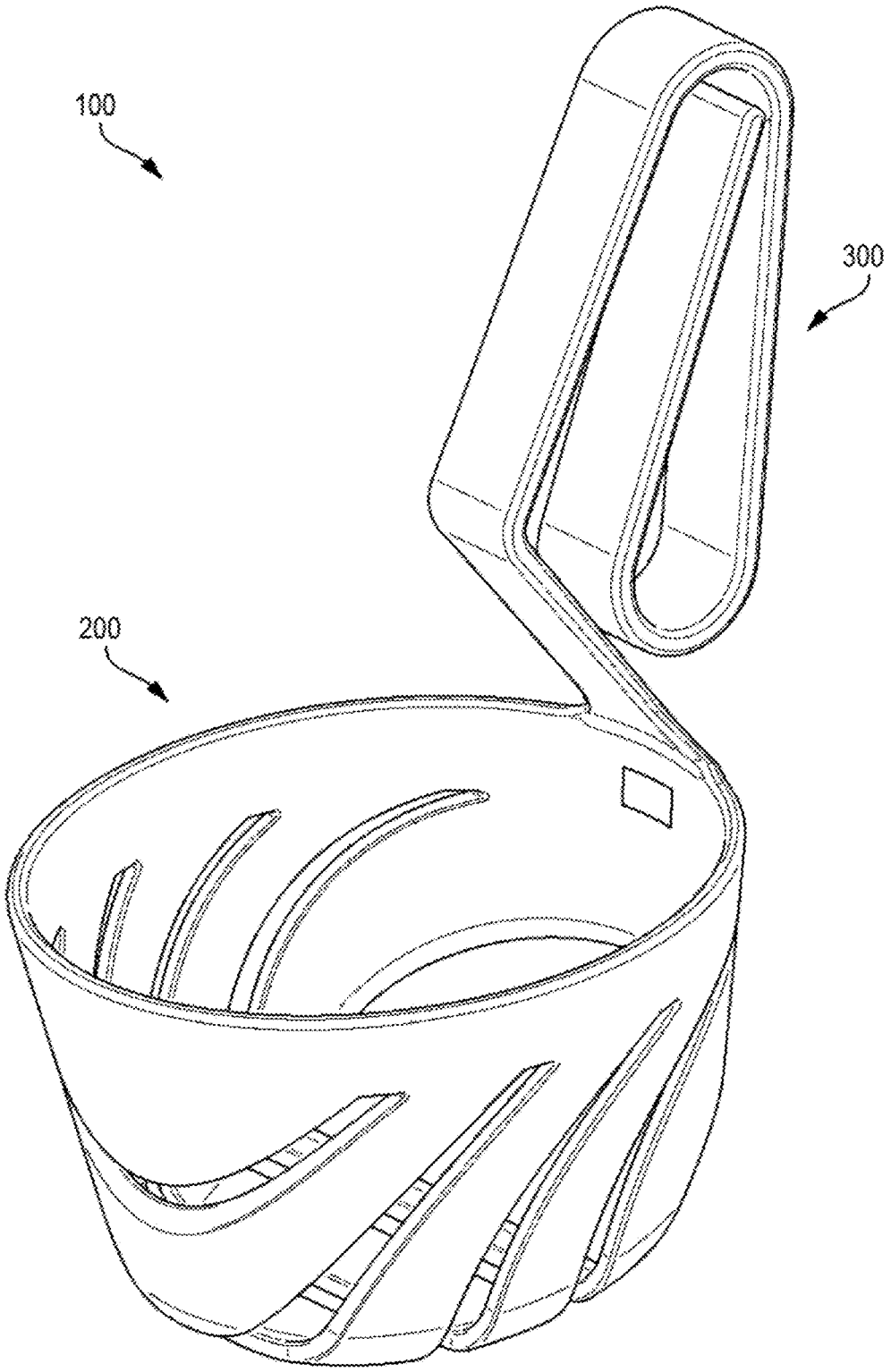
FIG. 1 depicts a perspective view of a toilet cleaning tablet holder, according to an embodiment of the present disclosure.
Figure 2:
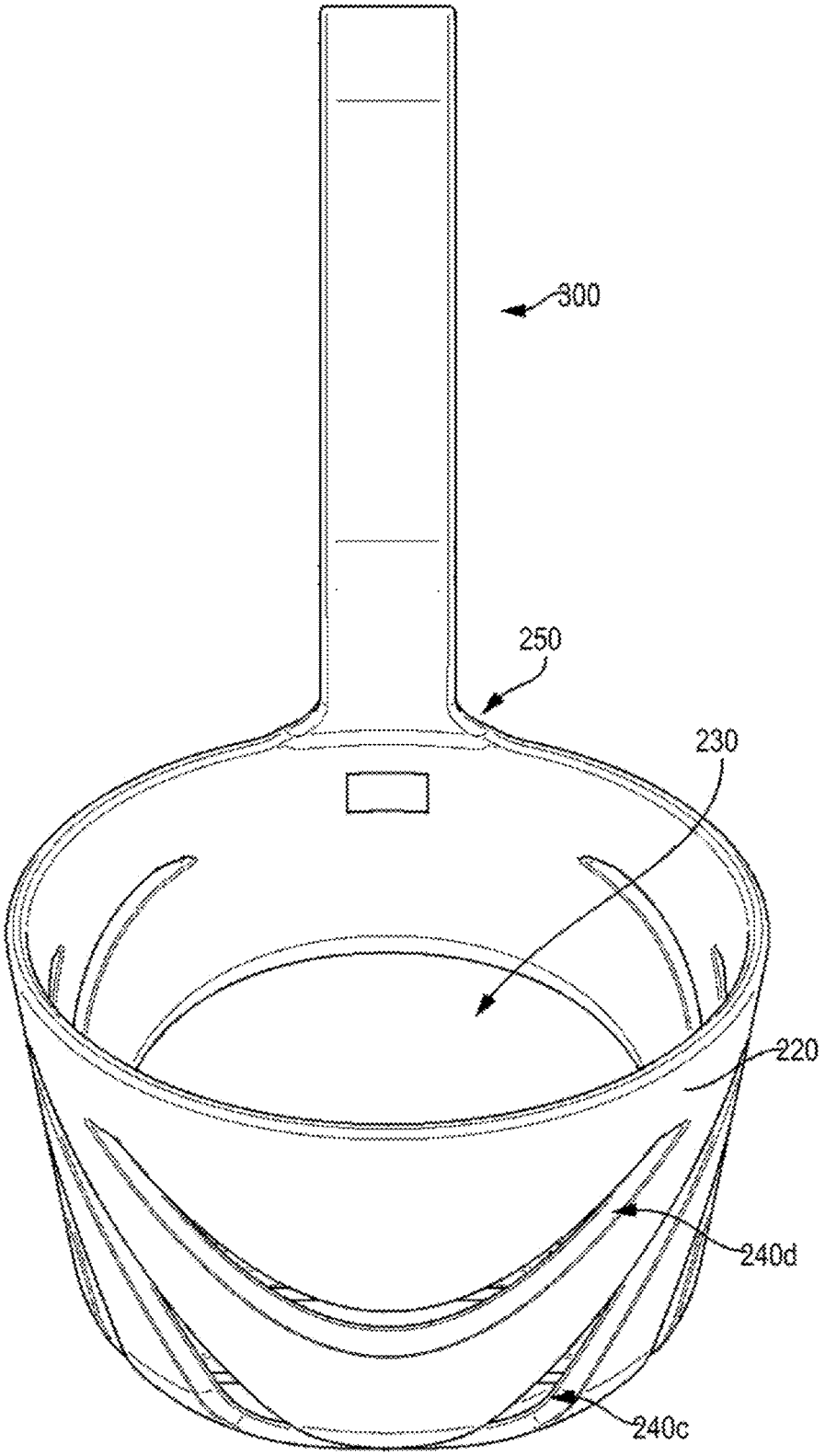
FIG. 2 depicts a front view of a toilet cleaning tablet holder, according to an embodiment of the present disclosure.
Figure 3:
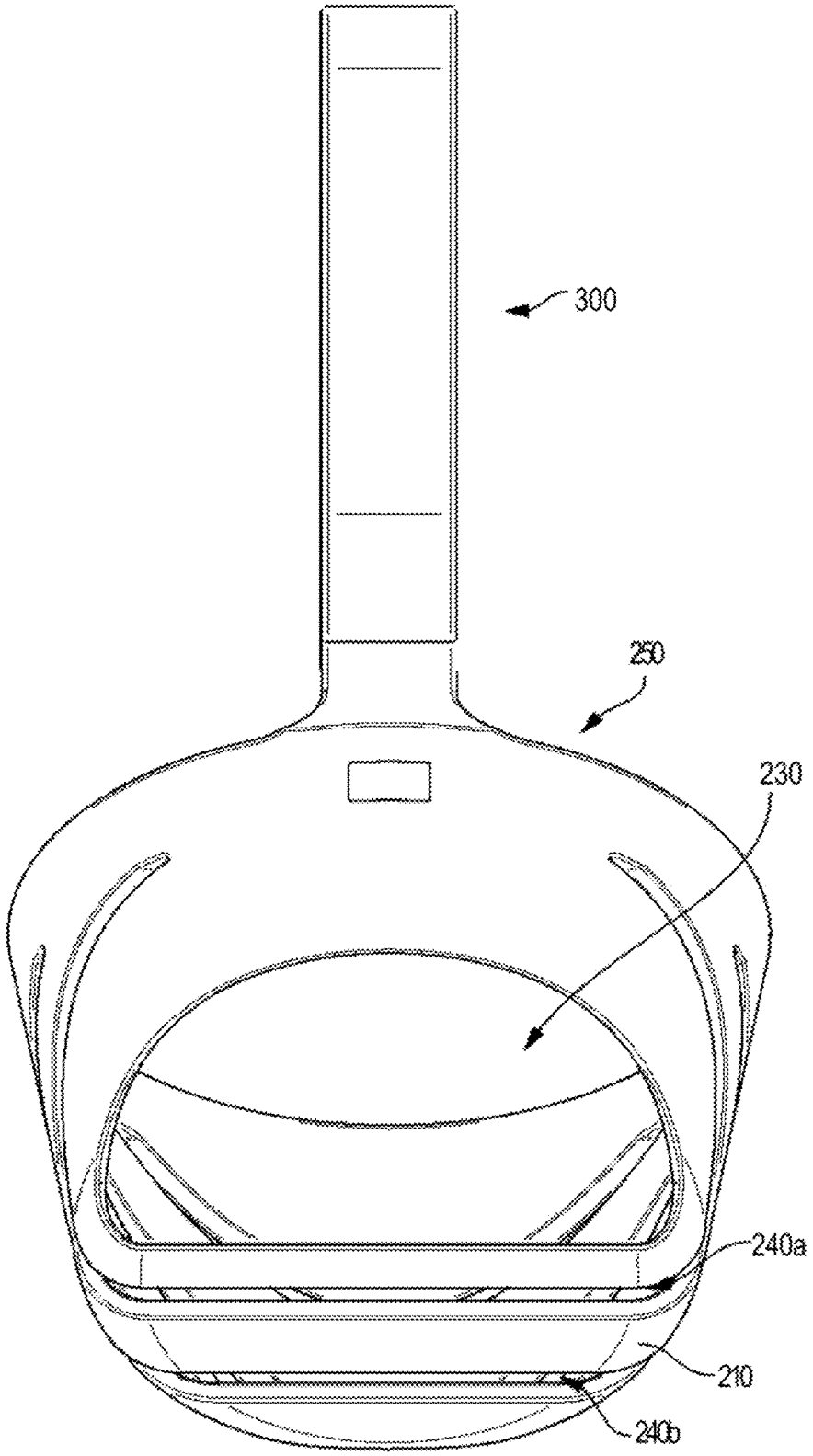
FIG. 3 depicts a back view of a toilet cleaning tablet holder, according to an embodiment of the present disclosure.

The present disclosure relates to an in-toilet tablet holder 100 that can maximize the efficacy and longevity of commonly used, reusable, dissolvable toilet cleaning tablets 500. While these tablets 500 are traditionally stored outside the toilet 400 between manual scrubbing operations, the present disclosure permits the tablets 500 to be stored within the toilet bowl 400 itself. This configuration not only streamlines storage, but also allows for continuous in-toilet cleaning and deodorization during and between flushes. When the need arises for manual cleaning, the tablet 500 can be retrieved from the tablet holder 100 and attached to a wand for scrubbing, thus allowing for a more integrated approach to toilet hygiene.

In some embodiments, the tablet holder 100 is realized through a basket-and-arm assembly. An arm mechanism 300 hooks securely over the toilet rim 400, positioning the attached basket 200 within the toilet bowl 400. The design of the basket 200 includes a bottom surface 210 featuring an aperture cutout 230, which allows the basket 200 to be oriented in an inclined position relative to a horizontal plane or the toilet bowl rim's 400 upper surface. This aperture cutout 230 serves as an interface for the tablet 500 to interact with flushing water. To further extend the utility of the tablet 500 as it dissolves over time, ridged cutouts 240 are present on the bottom surface 210 and side wall 220. The structures between these ridged cutouts 240 function as ledges, directing the diminishing tablet 500 back towards the aperture cutout 230, ensuring persistent contact with the toilet bowl water for sustained cleaning efficacy.

FIG. 1 depicts a perspective view of a toilet cleaning tablet holder 100, according to an embodiment of the present disclosure. In some embodiments, the tablet holder 100 has dimensions tailored to fit standard-sized toilet bowls 400. The assembly consists of two main components: a lower basket 200 with both an aperture cutout 230 and ridged cutouts 240 designed for optimal tablet-water interaction, and an arm mechanism 300 for secure attachment to the toilet bowl 400.

In some embodiments, the lower basket 200 is cylindrical in shape, with dimensions that can accommodate one or more toilet cleaning tablets 500. The lower basket 200 can house a cleaning tablet 500 and facilitate the dissolution of the tablet 500 due to contact between the tablet 500 and toilet water, which typically flows from the side of the toilet bowl 400 during flushing.

In some embodiments, as depicted in FIGS. 2-5 and FIG. 7, the basket 200 includes ridged cutouts 240 on its bottom surface 210 and side wall 220. When installed in a toilet 400, these ridged cutouts 240 are located further away from the wall of the toilet bowl 400. These ridged cutouts 240 serve dual functions. They not only enable drainage from the side-flowing toilet bowl water but also improve the dissolution of the cleaning tablet 500 by optimizing the positioning the tablet 500 within the basket 200. This ensures more consistent contact between the tablet 500 and the water flowing from the side of the toilet bowl 400, even as the tablet 500 dissolves and diminishes in size. In some embodiments, an additional, larger cutout, or aperture cutout 230, exists on the opposite side of the side wall 220 from the ridged cutouts 240. This aperture cutout 230 permits the basket 200 to sit flush against the curved or angled interior of the toilet bowl 400. This enhances both the stability of the basket 200 and effective use of the cleaning tablet 500. In some embodiments, cleaning tablets 500 are seated within the aperture cutout 230, allowing the tablets to maintain proximity to the side-flowing water, even as they diminish in size.

In some embodiments, an arm mechanism 300 extends from the rim of the basket 250. The arm mechanism 300 can be used to securely attach the tablet holder 100 to the rim of the toilet bowl 400. This helps the tablet holder 100 remain stationary even during flushing or when inserting or removing tablets 500. The arm mechanism 300 can provide a secure grip on the toilet bowl rim 400, accommodating various toilet designs while maintaining the tablet holder's 100 stability.

In some embodiments, the material selected for the construction of the tablet holder 100 is plastic. In some embodiments, the material selected for the construction of the tablet holder 100 is rubber. In some embodiments, the material selected for the construction of the tablet holder 100 is a synthetic material that shares certain characteristics with plastic and rubber, such as being moldable, durable, and resistant to various environmental factors. While such synthetic materials are the material of choice in some embodiments, the subject matter disclosed herein is not so limited. Instead, as one of ordinary skill in the art will appreciate, alternative materials can be used in combination with or as an alternative to said materials.

Figure 8:
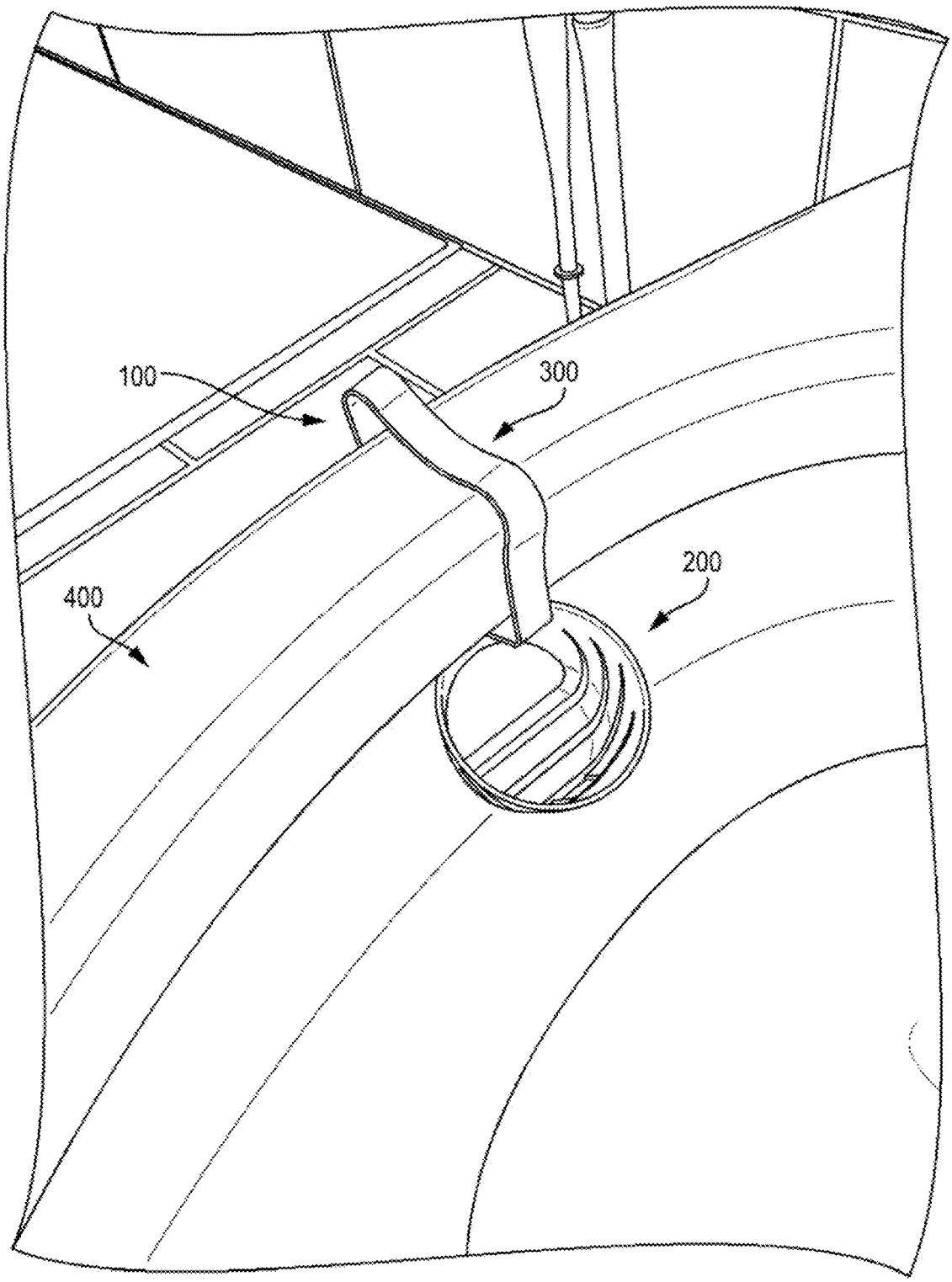
FIG. 8 depicts a toilet cleaning tablet holder installed in a toilet, according to an embodiment of the present disclosure.

FIG. 8 depicts a toilet cleaning tablet holder 100 installed in a toilet 400, according to an embodiment of the present disclosure. This figure illustrates the interplay between the tablet holder 100 and the toilet bowl 400. The aperture cutout 230 of the lower basket 200 is flush with the interior surface of the toilet bowl 400. This alignment allows a toilet cleaning tablet 500 seated within the aperture cutout 230 to actively interface with water as it circulates within the toilet bowl 400 during flushing. The basket 200 itself is designed to sit above the water line, preventing premature dissolution while still allowing the tablet 500 to interact with the water flow. FIG. 8 also depicts how the arm mechanism 300 securely drapes over the rim of the toilet bowl 400, emphasizing its role in maintaining the stability and optimal positioning of the tablet holder 100.

FIGS. 2-7 are various views of a toilet cleaning tablet holder 100, according to an embodiment of the present disclosure. In some embodiments, the tablet holder 100 consists of two key components: a basket 200 for holding the dissolvable cleaning tablet 500 and an arm mechanism 300 attached to the basket 200.

In some embodiments, the basket 200 features a bottom surface 210 and at least one side wall 220. An aperture cutout 230 is present through both the bottom surface 210 and the side wall 220; said aperture cutout 230 ensures that a dissolvable cleaning tablet 500 within the basket 200 can interface with water from the toilet bowl 400. This aperture cutout 230 is positioned proximate to and below the arm mechanism 300 and is shaped to accommodate various toilet bowl 400 geometries, allowing the basket 200 to achieve substantially flush alignment with the inner wall of the toilet bowl 400. In some embodiments, because of the aperture cutout's 230 alignment with the toilet bowl's surface 400, said bottom surface 210 of the basket 200 portion is positioned at a downward angle with respect to the toilet rim 400. In some embodiments, the close positioning between the tablet 500 and the toilet water (flowing from the side of the toilet 400 during a toilet flush) results in more efficient dispersion of the chemical or fragrances released by the cleaning tablet 500. Essentially, the flush fit allows the basket 200 to sit nearly flat against the wall of the toilet bowl 400, which increases tablet-water contact through the lifespan of a cleaning tablet 500.

In some embodiments, the basket 200 is shaped with a downward angular orientation relative to the horizontal plane formed by the toilet bowl rim 400. The angular orientation of the basket 200 is due to the previously described aperture cutout 230. This aperture cutout 230 allows the basket to achieve a flush alignment with the inner wall of the toilet bowl 400, and, as a result, creates a downward angular orientation. In some embodiments the angle is between 15 and 75 degrees. In this configuration, the basket 200 achieves a few functional outcomes. First, the angle is acute enough to allow the bottom surface 210 of the basket 200 to still serve as a stabilizing force for securing the tablet 500. This minimizes the chance of the tablet 500 being dislodged due to external forces such as water flow during flushing. Second, the angle is sufficiently steep enough to direct water flow towards the ridged cutouts 240 in the basket, aiding in efficient drainage and dissolution of the tablet 500. Additionally, as the tablet 500 undergoes the process of dissolution and consequently reduces in size, the angle permits the upward repositioning of the tablet 500 along the ridged cutouts 240, or ledges, thereby sustaining its contact with the water entering the basket 200 through the aperture cutout 230.

One of the other advantages of the aperture cutout 230 is the stability it provides, especially when considering the variability in toilet bowl 400 shapes. In this context, the resulting form is versatile; it can accommodate toilet bowls 400 that have various shapes, such as differing curvatures and depths, while still ensuring secure retention of the tablet 500. In some embodiments, the chosen angle works with the ridged cutouts 240 incorporated into the design of the basket 200 to facilitate efficient drainage, thereby preventing the accumulation of excess water.

Figure 9A:
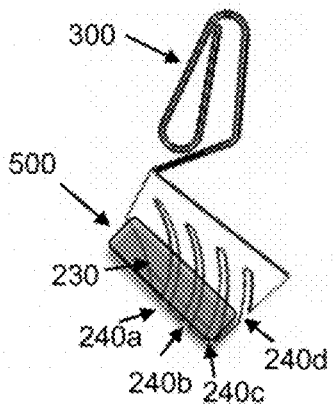
FIGS. 9A-9C illustrate a toilet cleaning tablet's position in a toilet cleaning tablet holder at various levels of dissolution, according to embodiments of the present disclosure.
Figure 9B:
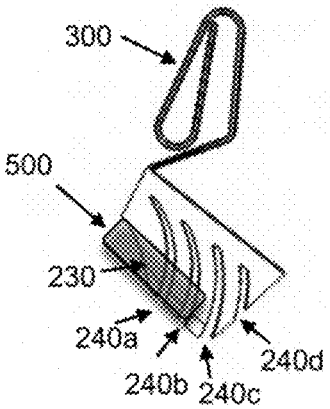
Figure 9C:
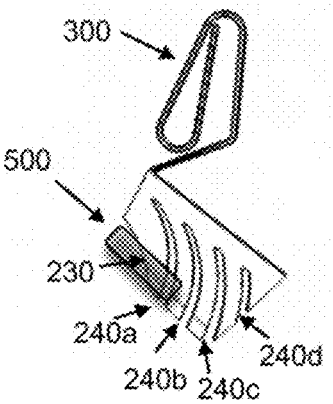

FIGS. 9A-9C illustrate a toilet cleaning tablet's position in a toilet cleaning tablet holder at various levels of dissolution, according to embodiments of the present disclosure. In some embodiments, the bottom surface 210 of the basket incorporates multiple ridged cutouts 240 that extend vertically from the bottom surface 210 and then laterally along the side wall 220 of the basket, on the opposite side of the basket 200 as the aperture cutout 230. In some embodiments, four ridged cutouts 240*a*-240*d* are incorporated into the design. The ridged cutouts 240 serve multiple functions. First, they facilitate effective drainage of water, which primarily enters the basket 200 from water flow emanating from the side of the toilet bowl 400 through the aperture cutout 230 during a toilet flush. The positioning and geometry of the ridged cutouts 240 ensures that water does not accumulate within the basket 200, thereby mitigating any concerns about water stagnation within the basket 200 itself. Moreover, these ridged cutouts 240 are conducive to effective ventilation, which both aids in drying and facilitates better emission of fragrance from the tablet 500. Second, as the cleaning tablet 500 dissolves and diminishes in size over time, these ridged cutouts 240 allow for the tablet 500 to be repositioned upward along the ridges, ensuring consistent tablet-water contact throughout the lifecycle of the tablet 500. In some embodiments, the ridged cutouts 240 could take various shapes and placements to adapt to different functional requirements, manufacturing constraints, or aesthetic appeals.

In some embodiments, the design of the ridged cutouts 240 in the basket 200 optimizes the interaction between the cleaning tablet 500, the basket 200, and the water flow within the toilet 400. Specifically, the basket 200 maintains a downward angular orientation relative to the horizontal plane formed by the rim of the toilet bowl 400. As the cleaning tablet 500 dissolves and naturally reduces in size, conventional tablet holders might risk losing consistent tablet-water contact, thereby jeopardizing the effectiveness of the cleaning process. However, the angular orientation in this design serves as a compensatory mechanism; the tablet 500 can be guided along a predetermined path within the basket, back towards the aperture cutout 230, facilitated by the ridged cutouts 240. These ridged cutouts 240 function as ledges that promote repositioning the tablet 500 within the basket 200 as the tablet 500 decreases in size. This repositioning is essential for maintaining consistent contact between the diminishing tablet 500 and the water flow, some of which enters the basket via the aperture cutout 230. In this way, the geometry of the basket 200 and the orientation of the ridged cutouts 240 ensures that the tablet 500 remains in effective contact with the water throughout its lifecycle. The interaction between the angle and the ridged cutouts 240 enhances the dispersion efficacy of the cleaning tablets 500 by ensuring ongoing tablet-water contact.

In some embodiments, the internal dimensions of the basket 200 can accommodate tablets 500 designed for various purposes related to toilet cleaning. In some embodiments, the tablets 500 are disc-shaped. As a non-limiting example, the embodiment utilizes dissolvable tablets 500 that have been specifically formulated for toilet cleaning applications. These cleaning tablets 500 can deliver targeted cleaning and deodorizing effects and are versatile in their modes of deployment. First, they can be placed in a basket 200 such as the one described herein, facilitating gradual dissolution and ongoing sanitation and deodorization during flush cycles. Second, these tablets 500 can be designed to affix to a cleaning wand, allowing manual scrubbing of the toilet bowl 400. Third, some embodiments of these tablets 500 can be used for both placement in a basket 200 and for affixing to a cleaning wand. For example, in such embodiments, a user may connect a toilet wand to the tablet 500 while the tablet 500 is in the basket 200 by pressing the toilet wand into the tablet 500, which in some cases, forces the tablet 500 through the aperture cutout 230 and against the toilet bowl wall to provide enough counter-force to connect the toilet wand to the tablet 500. These multi-functional tablets 500 provide flexibility in choosing between automated, gradual cleaning via dissolution in the basket 200 and more immediate, manual cleaning via attachment to a cleaning wand.

In some embodiments, the dimensions of the basket 200 are greater than those of the cleaning tablets 500, thereby providing additional room within the basket 200 when a tablet 500 is present. This additional space is designed to facilitate ease of insertion and removal of the tablets 500 and accounts for the unstructured or random positioning that the tablets 500 might assume upon being placed into the basket 200. This design thus allows for the tablets 500 to be removed either manually by hand or by attaching them to the end of a specialized toilet-cleaning wand, thereby offering users a choice of methods for tablet 500 removal based on their preference or specific cleaning requirements. This additional room enhances user experience by mitigating the likelihood of tablets 500 becoming lodged within the basket 200, thereby obviating the need for excessive force during their removal or repositioning. Moreover, the shape of the basket 200 can accommodate the disc-like form factor of the tablets 500. This feature allows the tablets 500 to be more easily and correctly positioned within the basket 200, referring to the orientation of the tablet 500 such that it is in contact with the aperture cutout 230 that is exposed to the water flow from the side of the toilet bowl 400.

In some embodiments, referring back to FIGS. 4-5, the system includes an arm mechanism 300. Said arm mechanism 300 is comprised of various structural portions, including a base 311, an upper portion 312 connected at an angle to the base, a flat portion 313, and an outer portion 314.

In some embodiments, the in-toilet tablet holder features an arm mechanism 300 extending from the rim of the basket 250. The arm's base 311 aligns vertically above the aperture cutout 230 of the basket 200. When installed, this aperture cutout 230 is positioned against the interior wall of the toilet bowl 400. In some embodiments, the arm's base 311 features a curvature that aligns with the exterior surface of a standard toilet bowl 400. This curvature aids in securing a more stable and flush fit of the basket against the toilet bowl. In some embodiments, the arm's base 311 extends vertically to an upper portion 312 connected at an angle to the base 311. In some embodiments, a flat portion 313 is connected at an angle to the upper portion 312 and extends outwards away from the lower basket 200. In some embodiments, an outer portion 314 is connected at a downward angle to the flat portion 313. In some embodiments, as depicted in FIG. 8, the arm mechanism 300 can be installed on the rim of the toilet bowl 400, beneath the toilet seat, by placing the base 311 and upper portion on the inside of the toilet bowl 400, the flat portion 313 along the rim of a toilet bowl 400, and the outer portion 314 on the exterior of a toilet bowl 400.

Figure 4:
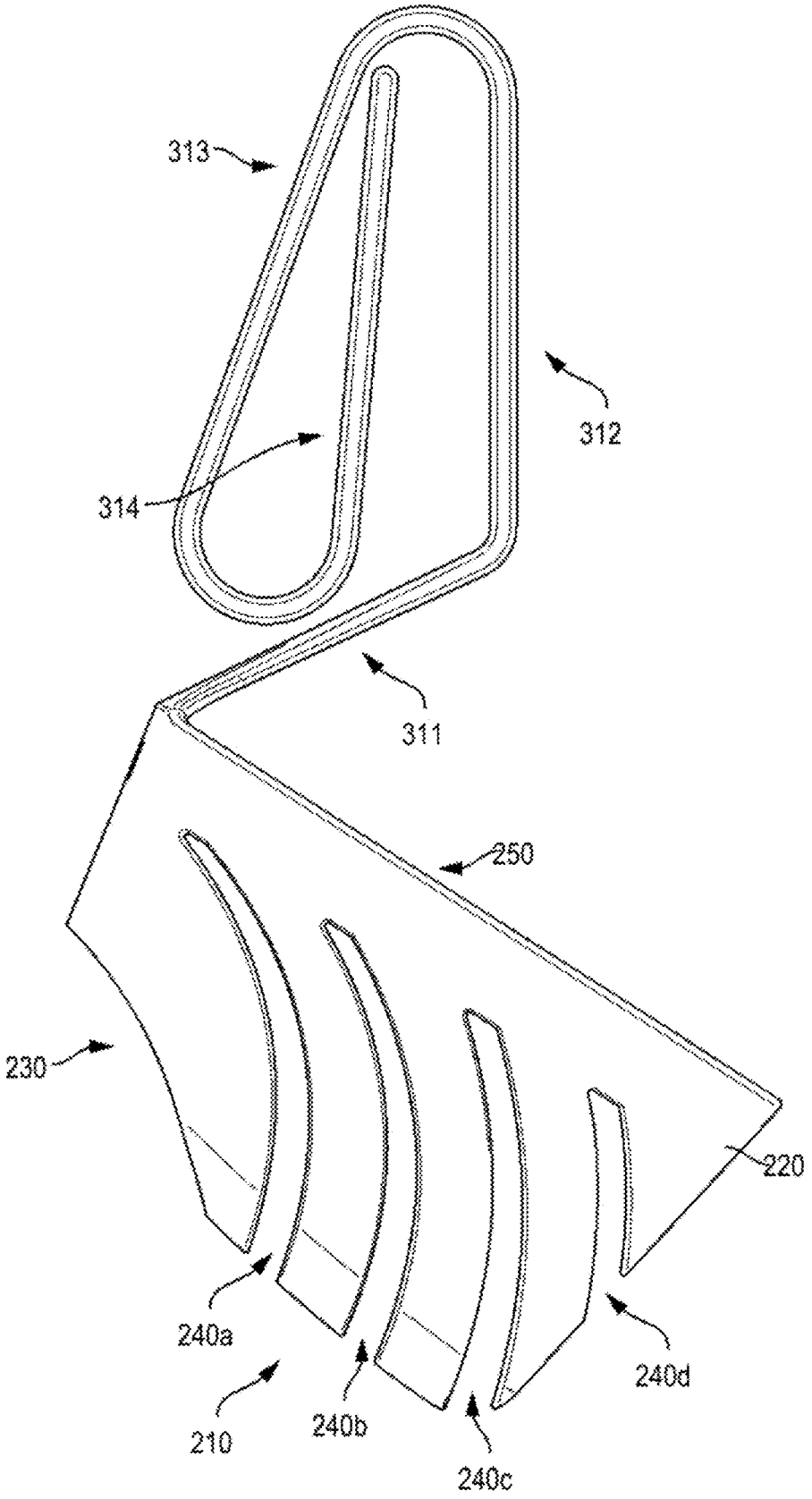
FIG. 4 depicts a right side view of a toilet cleaning tablet holder, according to an embodiment of the present disclosure.
Figure 5:
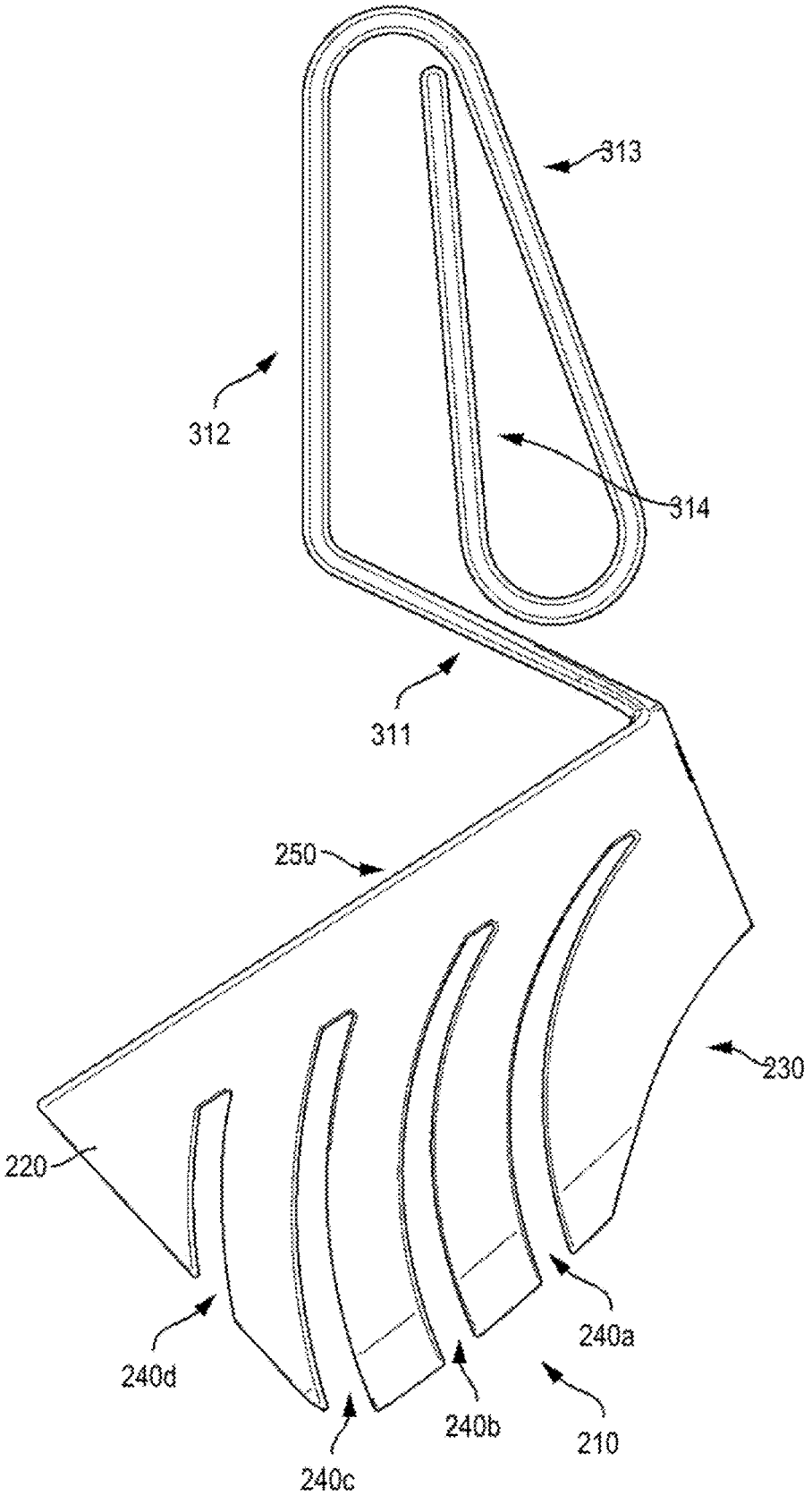
FIG. 5 depicts a left side view of a toilet cleaning tablet holder, according to an embodiment of the present disclosure.
Figure 6:
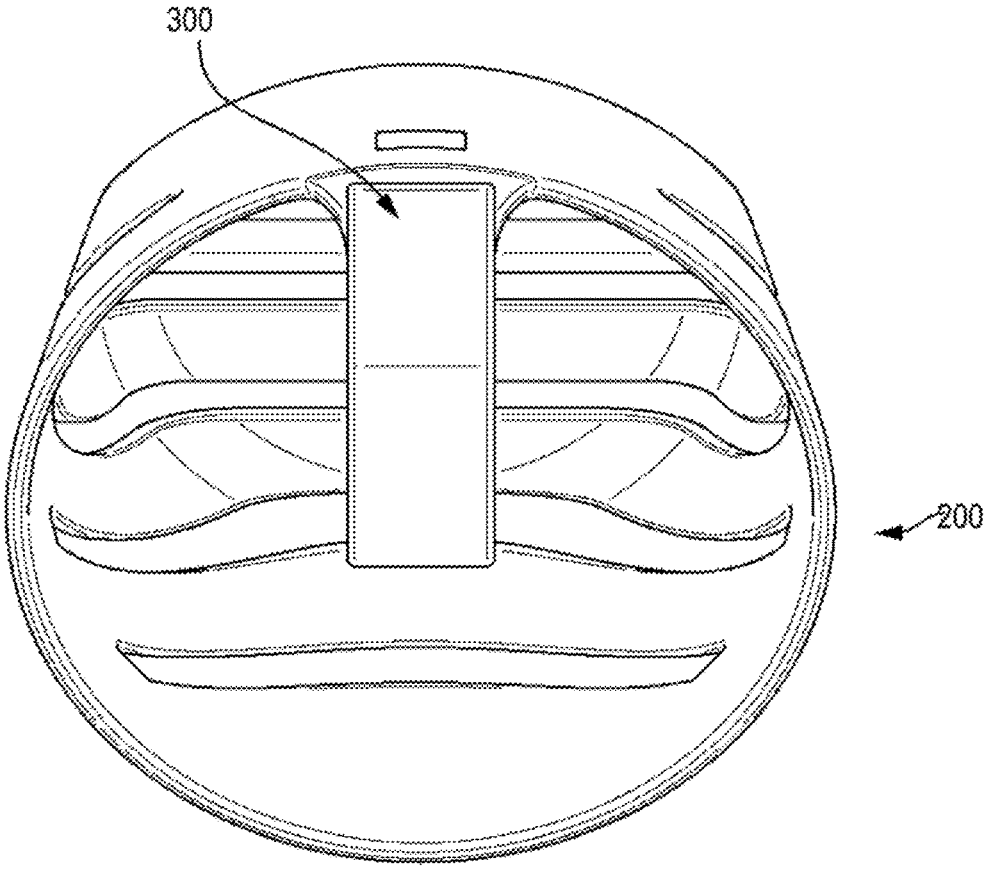
FIG. 6 depicts a top view of a toilet cleaning tablet holder, according to an embodiment of the present disclosure.
Figure 7:
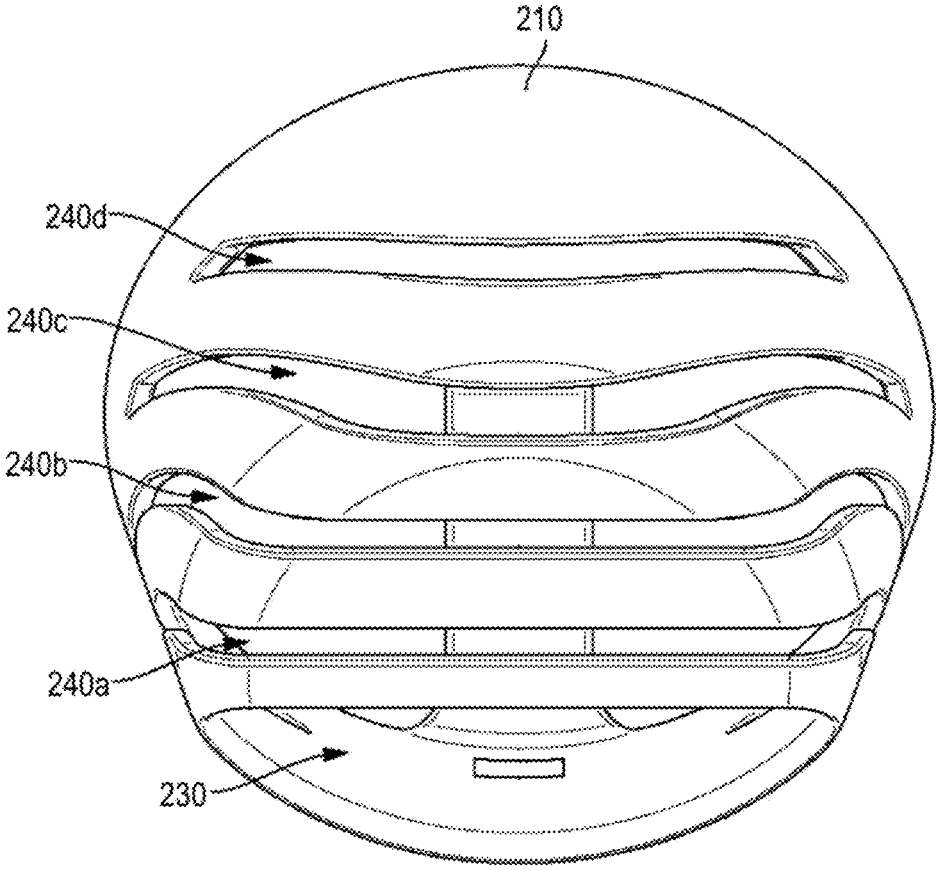
FIG. 7 depicts a bottom view of a toilet cleaning tablet holder, according to an embodiment of the present disclosure.

In some embodiments, as depicted in FIG. 1, FIGS. 4-5, the arm mechanism 300 can be curled within itself. The flat portion 313 can be bent downwards towards the direction of the basket 200 and the outer portion 314 can be bent upwards away from the direction of the basket 200. In some embodiments, the arm mechanism 300 can be curled as such for ease of storage or shipping and uncurled for placement over the rim of the toilet bowl 400.

The arm mechanism 300 can be constructed from the same or a different material than the basket 200. In some embodiments, the material selected for the construction of the arm mechanism 300 is plastic. In some embodiments, the material selected for the construction of the arm mechanism 300 is rubber. In some embodiments, the material selected for the construction of the arm mechanism 300 is a synthetic material that share certain characteristics with plastic and rubber, such as being moldable, durable, and resistant to various environmental factors. While such synthetic materials are the material of choice in some embodiments, the subject matter disclosed herein is not so limited. Instead, as one of ordinary skill in the art will appreciate, alternative materials can be used in combination with or as an alternative to said materials.

In some embodiments, the dimensions of the arm mechanism 300 can be optimized to ensure that the basket 200 is held securely either above or slightly below the toilet water level. The exact position may vary depending on the specific toilet 400 design. This variability in positioning is not limited by the function of the cleaning tablet 500. Being positioned above the water level allows the tablet 500 to emit fragrances, while a positioning slightly below the water level facilitates more intensive cleaning.

In some embodiments, the tablet holder's 100 arm mechanism 300 and lower basket 200 are interconnected via a snap-like connection 320 to accommodate easy attachment and detachment. The snap-like connection 320 may consist of a small, raised ridge on one component (either the basket 200 or the base 311 of the arm mechanism 300) that aligns with a corresponding groove on the other component. The ridge is designed to be inserted into the groove with a slight application of force, triggering an audible or tactile "snap" to confirm a secure connection. This connection 320 has specific tolerances to withstand the mechanical forces associated with operations, such as the insertion or removal of cleaning tablets 500. This design also facilitates modularity and ease of maintenance, allowing the user to separate the components for cleaning or replacement without compromising the structural integrity of the overall system.

In some embodiments, the connection between the arm mechanism 300 and the lower basket 200 can be achieved by other means. For instance, adhesive compounds could be employed to firmly secure the arm mechanism 300 to the basket 200. Additionally, mechanical fasteners could be used to connect the arm mechanism 300 and the basket 200. In another embodiment, the arm mechanism 300 and the basket 200 could be formed as a single unit.

In some embodiments, the tablet holder 100 is compatible with a specialized toilet wand designed for handling dissolvable toilet cleaning tablets 500. In some embodiments, the tablet 500 may be affixed to a toilet cleaning wand. The tablet 500 is pressed into the wand, leveraging the force generated against the toilet bowl 400 to ensure secure attachment for scrubbing operations. These cleaning tablets 500 feature a form factor that allows for them to be securely attached to, and detached from, the tablet wand. The design of the basket 200 offers sufficient space and structural contours that enable ease of operation when using the tablet wand. One aspect is the proximity of the basket 200 to the toilet bowl wall 400. This allows the user to leverage the toilet bowl wall 400 as a stable surface against which the tablet 500 can be pushed when attaching or detaching it to the wand. Specifically, by pressing the tablet 500 against the toilet bowl wall 400, it can achieve the necessary pressure or friction to engage with the wand's gripping or locking mechanism. This method allows for non-touch transfer and positioning of the cleaning tablet 500. In some embodiments, the tablet holder 100 and arm mechanism 300 can accommodate the mechanical forces associated with the wand operation. This helps the tablet holder 100 remain securely in place, even during the mechanical interactions necessitated by the operation of the tablet wand.

FIGS. 9A-9C illustrate the position of a toilet cleaning tablet 500 in a tablet holder 100 at various levels of dissolution, according to embodiments of the present disclosure. As the tablet 500 undergoes dissolution due to repeated flushes or extended periods of submersion, its dimensions reduce. Despite this reduction, the tablet 500 remains in an orientation that allows for continuous effective cleaning and deodorization, thanks to the ridged cutouts 240 acting as ledges and the aperture cutout 230 configured for optimal water-tablet interaction.

Example Use Case

The following example use case describes how an example of a tablet holder according to the present disclosure may be used. This section is intended solely for explanatory purposes and not for limitation.

To begin with the attachment of the tablet holder 100, the arm mechanism 300 should be positioned so that it drapes over the rim of the toilet bowl 400. If the toilet bowl rim 400 is wider than the arm mechanism's 300 resting position, users should expand or uncurl the arm mechanism 300 to accommodate the bowl's dimensions and then allow it to retract once placed, thereby securing it to the toilet bowl rim 400. Following the attachment, in embodiments that are compatible with a tablet wand, the wand may be used to pick up a dissolvable toilet cleaning tablet 500. This tablet 500 can be guided onto the bottom surface 210 of the basket 200 such that the tablet 500 is within the aperture cutout 230 and released from the toilet wand. Users then proceed to flush the toilet 400.

In some embodiments, the tablet 500 is designed to sustain multiple uses. This is facilitated by the shape of the tablet holder 100, which maintains optimal water-tablet contact even as the tablet 500 reduces in size. Should the tablet 500 require repositioning, perhaps due to partial dissolution, users can utilize the tablet wand to adjust the position of the tablet 500 within the basket 200. If users wish to manually scrub the toilet bowl 400, the tablet 500 can be removed from the basket 200 using the wand, applied directly to the toilet bowl for scrubbing, and then reinserted back into the basket 200 for continued use. Replacement of a fully dissolved or spent tablet 500 is straightforward and follows the initial steps of arm mechanism 300 attachment and tablet 500 placement. Finally, to remove the device, users simply lift the arm mechanism 300 off the toilet bowl.

The elements of the figures are not exclusive. Other embodiments may be derived in accordance with the principles of the invention to accomplish the same objectives. Although this invention has been described with reference to particular embodiments, it is to be understood that the embodiments and variations shown and described herein are for illustration purposes only. Modifications to the current design may be implemented by those skilled in the art, without departing from the scope of the invention.

While various illustrative embodiments incorporating the principles of the present teachings have been disclosed, the present teachings are not limited to the disclosed embodiments. Instead, this application is intended to cover any variations, uses, or adaptations of the present teachings and use its general principles. Further, this application is intended to cover such departures from the present disclosure that are within known or customary practice in the art to which these teachings pertain.

In the above detailed description, reference is made to the accompanying drawings, which form a part hereof. In the drawings, similar symbols typically identify similar components, unless context dictates otherwise. The illustrative embodiments described in the present disclosure are not meant to be limiting. Other embodiments may be used, and other changes may be made, without departing from the spirit or scope of the subject matter presented herein. It will be readily understood that various features of the present disclosure, as generally described herein, and illustrated in the Figures, can be arranged, substituted, combined, separated, and designed in a wide variety of different configurations, all of which are explicitly contemplated herein.

The present disclosure is not to be limited in terms of the particular embodiments described in this application, which are intended as illustrations of various features. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. It is to be understood that this disclosure is not limited to particular methods, reagents, compounds, compositions or biological systems, which can, of course, vary. It is also to be understood that the terminology used herein is for the purpose of describing particular embodiments only and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (for example, the term "including" should be interpreted as "including but not limited to," the term "having" should be interpreted as "having at least," the term "includes" should be interpreted as "includes but is not limited to," et cetera). While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention.

In addition, even if a specific number is explicitly recited, those skilled in the art will recognize that such recitation should be interpreted to mean at least the recited number (for example, the bare recitation of "two recitations," without other modifiers, means at least two recitations, or two or more recitations). Furthermore, in those instances where a convention analogous to "at least one of A, B, and C, et cetera" is used, in general such a construction is intended in the sense one having skill in the art would understand the convention (for example, "a system having at least one of A, B, and C" would include but not be limited to systems that have A alone, B alone, C alone, A and B together, A and C together, B and C together, and/or A, B, and C together, et cetera). In those instances where a convention analogous to "at least one of A, B, or C, et cetera" is used, in general such a construction is intended in the sense one having skill in the art would understand the convention (for example, "a system having at least one of A, B, or C" would include but not be limited to systems that have A alone, B alone, C alone, A and B together, A and C together, B and C together, and/or A, B, and C together, et cetera). It will be further understood by those within the art that virtually any disjunctive word and/or phrase presenting two or more alternative terms, whether in the description, sample embodiments, or drawings, should be understood to contemplate the possibilities of including one of the terms, either of the terms, or both terms. For example, the phrase "A or B" will be understood to include the possibilities of "A" or "B" or "A and B."

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed.

We claim:

1. An in-toilet tablet holder for a dissolvable cleaning tablet, the in-toilet tablet holder comprising:

a basket for holding the dissolvable cleaning tablet, the basket comprising a bottom surface and at least one side wall, wherein an aperture cutout is formed through the bottom surface and the at least one side wall; and an arm mechanism attached to the basket and configured to attach to a rim of a toilet such that at least a portion of a perimeter of the aperture cutout is in contact with a bowl of the toilet, wherein the aperture cutout is angled with respect to the bottom surface such that the bottom surface is at an angle with respect to the rim of the toilet when the perimeter of the aperture cutout is in contact with the bowl of the toilet, wherein the dissolvable cleaning tablet within the basket can contact the bowl of the toilet through the aperture cutout such that water from the bowl of the toilet can interface with the dissolvable cleaning tablet.

2. The in-toilet tablet holder of claim 1, wherein the angle is between 15 and 75 degrees.

3. The in-toilet tablet holder of claim 1, wherein the bottom surface further forms therethrough a plurality of ridged cutouts, and wherein each of the plurality of ridged cutouts are configured to act as a ledge to locate at least a portion of the dissolvable cleaning tablet in contact with the bowl of the toilet through the aperture cutout.

4. The in-toilet tablet holder of claim 3, wherein each of the plurality of ridged cutouts are parallel with one another.

5. The in-toilet tablet holder of claim 1, wherein the bottom surface further forms therethrough a plurality of ridged cutouts, wherein each of the plurality of ridged cutouts are configured to act as a ledge to locate at least a portion of the dissolvable cleaning tablet in contact with the bowl of the toilet through the aperture cutout, wherein the at least one side wall further forms therethrough a plurality of side cutouts through which water from the toilet can flow, and wherein each of the plurality of ridged cutouts is connected to at least one of the plurality of side cutouts such that each of the plurality of ridged cutouts and side cutouts are formed by one cutout.

6. The in-toilet tablet holder of claim 5, wherein water can flow in to and out of the basket through one or more of the plurality of side cutouts.

7. The in-toilet tablet holder of claim 1, wherein the arm mechanism comprises:

a base portion;

an upper portion connected to and at an angle with respect to the base portion;

a flat portion;

an outer portion; and wherein the base portion is configured to attach to the rim of the basket, the upper portion is configured to maintain the basket at a predetermined height above the bowl of the toilet, the flat portion is configured to rest against the rim of the toilet, the outer portion is designed to rest against an exterior surface of the bowl of the toilet.

8. The in-toilet tablet holder of claim 7, wherein the arm mechanism is configured to curl within itself, the curl facilitated by the flat portion being bendable downwards towards the basket and the outer portion being bendable upwards away from the basket; and wherein the arm mechanism is further configured to uncurl for placement over the rim of a toilet bowl.

9. An in-toilet tablet holder for a dissolvable cleaning tablet, the in-toilet tablet holder comprising:

an arm mechanism attached to a basket and configured to attach to a rim of a toilet, wherein the basket is attached to the arm mechanism and configured such, when installed on the toilet, that a bottom surface of the basket is at an angle with respect to a top surface of the rim of the toilet, and wherein the bottom surface of the basket forms therethrough a plurality of ridged cutouts configured to act as a ledge to locate at least a portion of the cleaning tablet in closer proximity to a bowl of the toilet.

10. The in-toilet tablet holder of claim 9, wherein each of the plurality of ridged cutouts are parallel with one another.

11. The in-toilet tablet holder of claim 9, wherein the arm mechanism comprises:

a base portion;

an upper portion connected to and at an angle with respect to the base portion;

a flat portion;

an outer portion; and wherein the base portion is configured to attach to the rim of the toilet, the upper portion is configured to maintain the basket at a predetermined height above the bowl of the toilet, the flat portion is configured to rest against the rim of the toilet, and the outer portion is designed to rest against an exterior surface of the bowl of the toilet to stabilize the in-toilet tablet holder.

12. The in-toilet tablet holder of claim 9, wherein the cleaning tablet within the basket may be configured to attach to a wand, said wand being pressable into the cleaning tablet, and wherein a force required for attachment is provided by the cleaning tablet either abutting against the bowl of the toilet, abutting against the bottom surface of the basket, or both.

13. The in-toilet tablet holder of claim 9, wherein the basket further comprises at least one side wall comprising a plurality of side cutouts formed therethrough through which water from the toilet can flow.

14. The in-toilet tablet holder of claim 13, wherein water can flow in to and out of the basket through one or more of the plurality of side cutouts.

15. The in-toilet tablet holder of claim 13, wherein each of the plurality of ridged cutouts is connected to at least one of the plurality of side cutouts such that each of the plurality of ridged cutouts and side cutouts are formed by one cutout.

16. The in-toilet tablet holder of claim 9, wherein the basket further comprises at least one side wall, wherein an aperture cutout is formed through the bottom surface and the at least one side wall, wherein the arm mechanism is configured to attach to the rim of the toilet such that at least a portion of a perimeter of the aperture cutout is in contact with the bowl of the toilet, and wherein the cleaning tablet within the basket can contact the bowl of the toilet through the aperture cutout such that water from the bowl of the toilet can interface with the cleaning tablet.

17. The in-toilet tablet holder of claim 16, wherein the aperture cutout is angled with respect to the bottom surface such that the bottom surface of the basket is at an angle with respect to the top surface of the rim of the toilet.

18. The in-toilet tablet holder of claim 16, wherein the angle is between 15 and 75 degrees.

* * * * *